United States Patent [19]

Davies

[11] 4,264,090

[45] Apr. 28, 1981

[54] ICE SKATE SCABBARD

[75] Inventor: J. Robert Davies, Markham, Canada

[73] Assignee: Rodac Developments Inc., Markham, Canada

[21] Appl. No.: 33,148

[22] Filed: Apr. 24, 1979

[51] Int. Cl.[3] ..... A63C 3/12

[52] U.S. Cl. ..... 280/825

[58] Field of Search ..... 280/11.38; 30/151, 296 A

[56] References Cited

U.S. PATENT DOCUMENTS

| | | | |
|---|---|---|---|
| 1,210,224 | 12/1916 | Silk | 280/11.38 |
| 1,925,697 | 9/1933 | Johnson | 280/11.38 |
| 3,637,231 | 1/1972 | Weidenbacker | 280/11.38 |

*Primary Examiner*—John J. Love
*Assistant Examiner*—Milton L. Smith
*Attorney, Agent, or Firm*—Sim & McBurney

[57] ABSTRACT

An ice skate scabbard has a blade-receiving slot and blade gripping members located at spaced locations along the slot to frictionally grip an ice skate blade received in the slot. The skate blade is held in the slot by the frictional grip and the scabbard may be removed manually when the skate blade needs to be exposed.

4 Claims, 5 Drawing Figures

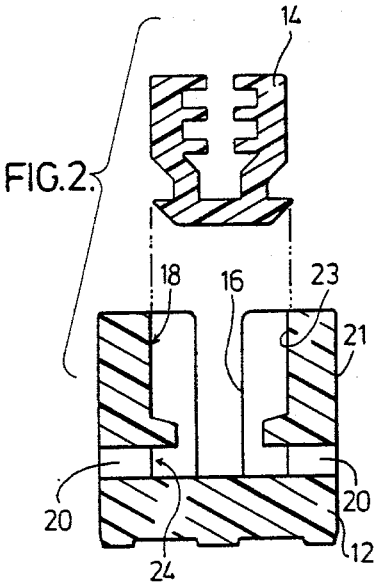
FIG.2.
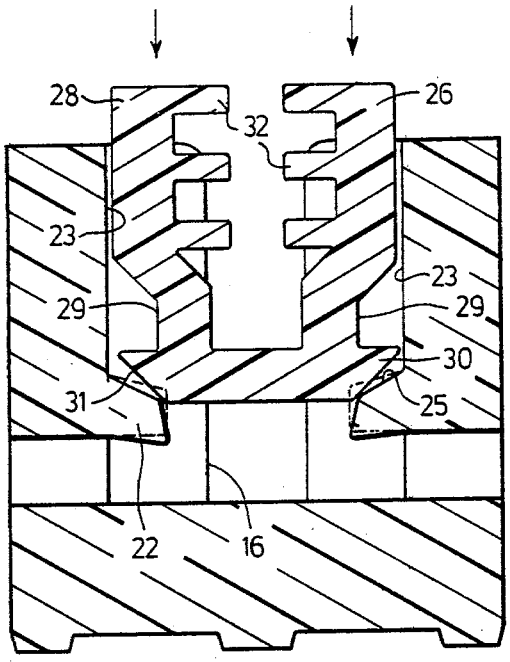
FIG.3.
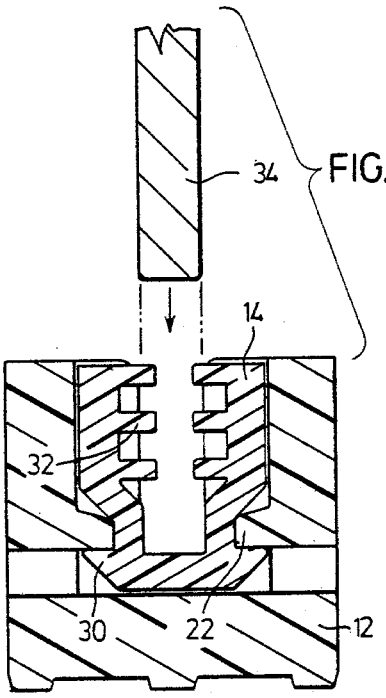
FIG.4.
FIG.5.
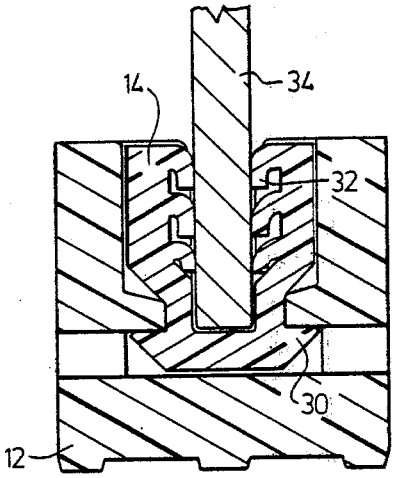

ICE SKATE SCABBARD

FIELD OF INVENTION

The present invention relates to ice skate scabbards for protection of ice skate blades when the skate is not in use.

BACKGROUND TO THE INVENTION

Skate scabbards are widely used to protect ice skate blades from damage and injury to others when the skates are not in use. Conventional ice skates have an elongate blade which includes a projecting heel portion. Skate scabbards in common use depend on attachment of a sprung element to the projecting heel to hold the skate scabbard on the blade.

Some newer skate blade designs, such as the so-called "Tuuk" skate, do not have a projecting heel portion, the toe and heel of the blade being rounded. It is, therefore, not possible to use the conventional skate scabbard with these skates. As far as we are aware, there is no product available which satisfactorily functions as a skate scabbard for the "Tuuk" skate or similar skates.

SUMMARY OF INVENTION

The present invention provides an ice skate scabbard which may be conveniently and effectively mounted on an ice skate blade of any design, include the heel-less designs, such as, the "Tuuk" blade.

In the present invention, an ice skate scabbard includes an elongate body member generally contoured to follow the skate contour and having an elongate skate blade-receiving slot formed in the top surface thereof, and at least two longitudinally-spaced blade gripping means mounted in the body for frictional grip of the side faces of an ice skate blade received in the slot.

By frictionally gripping the ice skate blade in the body slot, the scabbard is securely mounted over the blade edge sufficient to prevent accidental dislodgement therefrom and to prevent damage to the blade when the skate is not in use. When it is desired to expose the blade edge, manual removal is readily effected by the application of a force sufficient to overcome the frictional grip force.

BRIEF DESCRIPTION OF DRAWINGS

FIGS. 2 to 4 are sectional views taken on line II—II of FIG. 1 illustrating assembly of insert members within the body portion of the scabbard; and FIG. 5 is a sectional view taken on line II—II of FIG. 1 illustrating the scabbard in use.

DESCRIPTION OF PREFERRED EMBODIMENTS

Figure 1:
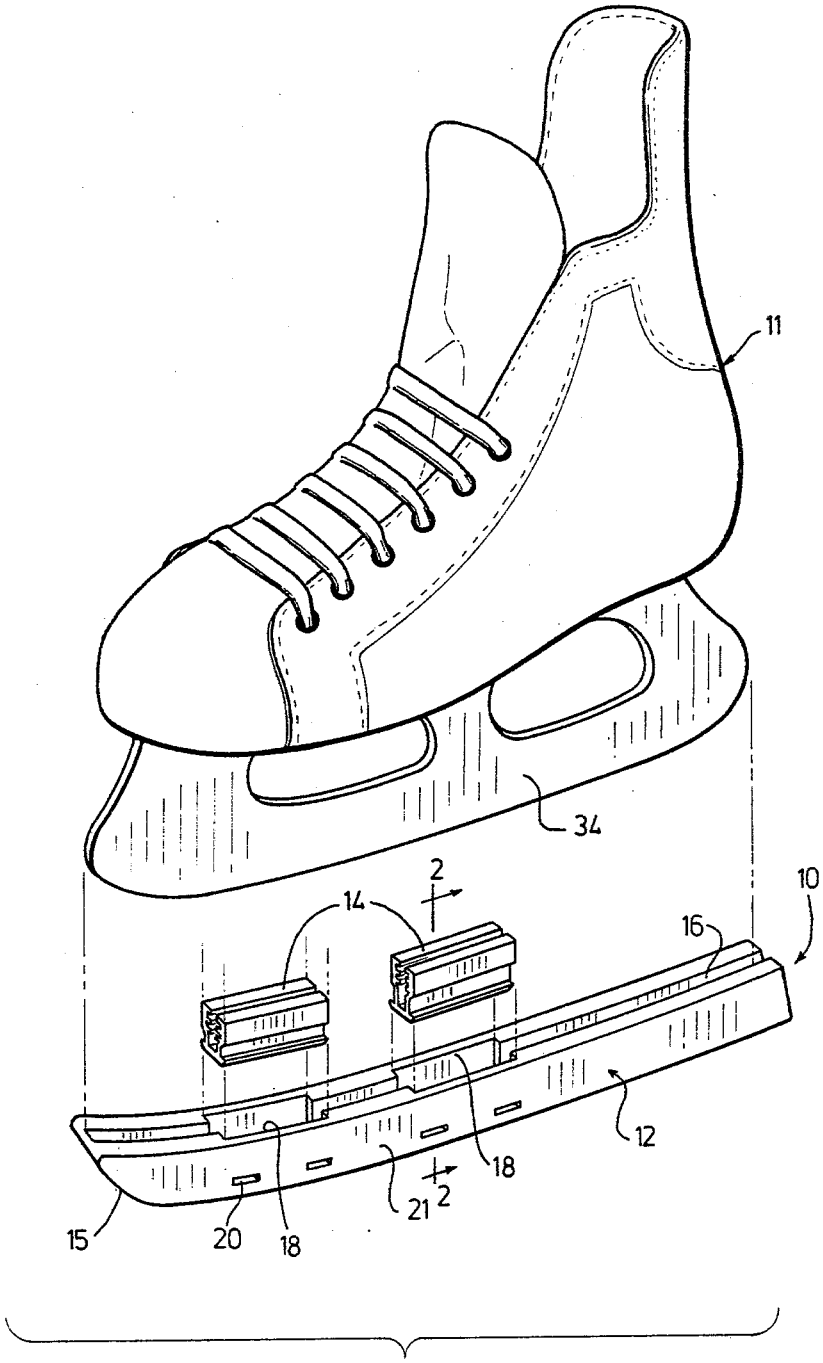
FIG. 1 is a perspective exploded view of a skate scabbard provided in accordance with one embodiment of the invention.

Referring to the drawings, an ice skate scabbard 10 for an ice skate 11 consists of an integrally-formed body member having a pair of longitudinally spaced-apart elongate blade gripping insert members 14 permanently mounted in the body member 12. It is preferred to provide two such insert members 14 but greater numbers may be provided, if desired.

The body member 12 preferably is molded from suitable rigid or semi-rigid plastic material and has a slightly bowed shape to conform to the skate blade contour. The forward longitudinal end of the body member 12 is tapered at 15 to provide assistance in walking on skates 11 having the scabbard 10 thereon.

The body member 12 has a longitudinal blade-receiving slot 16 formed along the length thereof from adjacent the forward end to the rearward end thereof and extending for a substantial depth therein. The blade-receiving slot 16 has a width at least sufficient to receive the width of skate blades intended to be received therein. Blade thicknesses vary depending on the intended use of the skates, such as, figure skating, ice hockey and recreational skating, and the slot 16 may be dimensioned to ensure that all common skate thicknesses can be accommodated. Alternatively, the slot 16 may be dimensioned to snugly receive only one particular skate thickness.

The blade-receiving slot 16 has 2 pairs of opposed elongate recesses 18 formed at spaced locations therealong and extending for the depth of the slot 16 to receive the blade-gripping insert members 14 in snug fit relationship with the body member 12, as described in more detail below.

A plurality of longitudinally-extending slits 20 are formed through the side walls 21 of the body member 12 generally perpendicularly thereto into communication with the lower extremities of the recesses 18, as may be seen more particularly in FIG. 2.

Inwardly-directed integral flanges 22 project from the side walls 23 of the recesses 18 immediately vertically above the entrance of the slits 20 into the recess 18 (see FIG. 2) and longitudinally extend substantially for the longitudinal length of the slits 20. The flanges 22 define with the lower extremity of the recess 18 blade gripping member securement undercuts 24. The flanges 22 have a downwardly-sloping upper surface 25 to assist in assembly of the blade gripping members 14 in the recesses 18, as outlined in more detail below.

The provision of slits 20 extending through the side walls of the body member 12 is necessary to enable the undercuts 24 to be molded. The slits 20 otherwise serve no function.

Each blade gripping member 14 is an elongate generally U-cross-sectionally shaped integral strip, which may be formed by extrusion and cut to the desired length, usually the length of the recess 18. The blade gripping member 14 has side walls 26 which engage the side walls 23 of the recesses 18 adjacent the upper part of the recesses and a lower transverse planar wall 28 integrally joining the side walls 26. The side walls 26 are waisted at 29 adjacent the transverse wall 28 and the transverse wall 28 is provided with planarly-extending projections 30. Each of the projections 30 has a triangular cross-section which includes an acutely upwardly angled surface 31 which assists in assembly of the insert member 14 in the body member 12.

The internal surfaces of the side walls 26 have a plurality of integrally formed blade-engaging elongate flanges or ridges 32 extending perpendicularly thereto for the length thereof in pairs towards each other to define a rectilinear gap therebetween which is less than the transverse dimension of the skate blade to be received in the scabbard 10. The rectilinear gap between the opposed pairs of flanges may be dimensioned to accommodate varying skate blade thicknesses or may be tailor-made for a particular blade thickness.

The blade gripping insert members 14 are permanently mounted in the recesses 18 of the body member 12 by placing the members 14 into the respective recesses 18, so that the acutely-angled surface 31 of the projection 30 engages the downwardly sloped surface 25 of the flange 22. Downward pressure on the insert member 14 causes the flange 22 to resiliently deform until the projection 30 passes it and is able to pass into the respective recess 24, whereupon the flange 22 resiliently snaps back to its initial position. This action is illustrated in FIGS. 2 and 3. In the assembled position, the inner extremities of the flanges 22 engage the waists 29 of the insert member 14.

Interference between the adjacent lower surface of the flange 22 and the upper surface of the projection 30 prevents the insert member 14 from being removed from the respective recess 18.

The flanges 32 in the insert member 14 are constructed of pliant resilient material to permit the projections to resiliently deform to increase the gap between opposed pairs so as to receive a skate blade 34 between the opposed pairs and frictionally grip the side faces of the skate blade 34 by the resilient action of the deformed flanges 32 (see FIGS. 4 and 5). The remainder of the blade gripping member 14 is constructed of rigid or semi-rigid material which is substantially undeformed during this receipt of the skate blade 34, and thereby acts as support for the resilient flanges 32.

Frictional engagement of the deformed flanges 32 and the side faces of the skate blade 34 holds the skate blade 34 in the slot 16 in the scabbard 10. No other gripping or securement means is required. When it is desired to remove the scabbard 10 from the blade 34, the body member 12 is pulled away from the blade to release the frictional grip of the resilient flanges 32 and the resilience of the flanges 32 restores them to their undeformed position (see FIG. 4).

The ice skate blade scabbard 10 of this invention, therefore, is rapidly, positively and easily positioned on a skate blade in a position which protects the blade edge and prevents accidential dislodgement. Since no portion of the skate blade, such as a projecting heel, is required, to support an attachment, the scabbard 10 may be used with the "Tuuk"-type of skate 11. The scabbard 10 may be used with any type of skate blade.

SUMMARY OF DISCLOSURE

The present invention, therefore, provides a unique ice skate scabbard useful with all types of skate blades, and which is simple in construction and easy to use. Modifications are possible within the scope of the invention.

What I claim is:

1. An ice skate scabbard, comprising:

an elongate integrally-formed body member constructed of substantially rigid polymeric material and having a generally rectangular cross-section, said body member having an ice skate blade-receiving slot therein extending continuously from adjacent the forward end of said body member to the rearward end of said body member and extending from the upper side of said body member downwardly in said body member a substantial distance towards the lower side thereof generally perpendicularly thereto, said body member having at least two pairs of opposed mirror-image shaped recesses formed therein in longitudinally spaced relationship to each other, each pair of elongate recesses being provided symmetrically on opposite sides of said slot and extending substantially for the depth thereof, for each pair of recesses, at least two elongate spaced-apart slits formed through each side wall of said body member into communication with the recesses adjacent the lower end thereof, flange members in number equal to the number of said slits extending from the side wall of each recess immediately above the entry of the respective slit into the respective recess, said flange members having a longitudinal dimension no greater than said slits and defining undercuts with the adjacent lower extremity of the recess, and integral insert members in number equal to the number of said pairs of recesses mounted in snug fit relation to said pairs of recesses, each insert member being of generally U-cross-sectional shape and extending substantially for the length of said recesses, each insert member having upstanding substantially rigid side walls engaging the adjacent side wall of the respective recess and a transverse planar substantially rigid lower wall integrally-joining the side walls, said transverse lower wall having projections extending into said undercuts in interference relationship with the respect flanges to inhibit removal of said insert member from said body member, each insert member having a plurality of deformable flanges extending generally perpendicularly from the inside surface of each side wall in opposed pairs to define a gap between each pair which is less than the width of said slot and less than the width of the skate blade to be received in said scabbard, said deformable flanges being constructed to be deformed to resiliently grip when said skate blade is received in said slot and to be resiliently restored to an undeformed state when said skate blade is not received in said slot.

2. The scabbard of claim 1 wherein said deformable flanges are of generally rectangular cross-section and extend for the length of the insert member.

3. The scabbard of claim 2 wherein said projections to said transverse lower wall have an upper generally planar surface for engagement with a similarly generally planar surface of said recess flange and an upwardly and outwardly angled lower surface, and said flange has a sloped upper surface.

4. The scabbard of claim 3 wherein said insert member side walls are waisted adjacent said transverse wall and said recess flanges extend into said waist.

* * * * *